US010914562B2

(12) United States Patent
Himmelmann

(10) Patent No.: US 10,914,562 B2
(45) Date of Patent: Feb. 9, 2021

(54) EXHAUST VALVE FOR MULTIPLE START TORPEDO

(71) Applicant: Hamilton Sundstrand Corporation, Charlotte, NC (US)

(72) Inventor: Richard A. Himmelmann, Beloit, WI (US)

(73) Assignee: HAMILTON SUNSTRAND CORPORATION, Charlotte, NC (US)

( * ) Notice: Subject to any disclaimer, the term of this patent is extended or adjusted under 35 U.S.C. 154(b) by 0 days.

(21) Appl. No.: 16/409,466

(22) Filed: May 10, 2019

(65) Prior Publication Data

US 2020/0355481 A1 Nov. 12, 2020

(51) Int. Cl.
*F42B 19/24* (2006.01)

(52) U.S. Cl.
CPC ..... *F42B 19/24* (2013.01)

(58) Field of Classification Search
CPC ..... F42B 19/00
USPC ..... 114/202.2
See application file for complete search history.

(56) References Cited

U.S. PATENT DOCUMENTS 1,820,822 A 8/1931 Orlando
2,938,485 A * 5/1960 Riley ..... F42B 19/18 114/20.1
4,346,662 A * 8/1982 Rogers ..... F42B 19/125 114/20.1
4,359,957 A * 11/1982 Schnabel ..... F42B 19/28 114/20.2
5,097,993 A * 3/1992 Davis ..... B67C 3/26 222/485
5,291,731 A * 3/1994 Duva ..... F02G 3/00 60/39.462
5,561,276 A * 10/1996 Quartarone ..... B63H 20/245 181/235
6,796,260 B1 9/2004 Barker

FOREIGN PATENT DOCUMENTS

FR 397532 A 5/1909
FR 2234500 A1 1/1975

OTHER PUBLICATIONS

Partial European Search Report; Application No. 19211661.4; dated Jul. 13, 2020; 11 pages.
EP Search Report for Application No. 19211661.4-1011; dated Oct. 16, 2020; 11 pages.

* cited by examiner

*Primary Examiner* — Joshua E Freeman
(74) *Attorney, Agent, or Firm* — Cantor Colburn LLP

(57) ABSTRACT

Disclosed is a multiple start torpedo including an aft body having an exhaust conduit defining a turbine end and a seawater end having an orifice. The multiple start torpedo includes an exhaust valve associated with the exhaust conduit including. The exhaust valve includes a fore section having a head and a valve stem. The exhaust valve includes an aft section tapered from the turbine end to the seawater end and defining a receptacle sized to receive the valve stem. The exhaust valve includes a biasing member disposed to bias the head in an extended position spaced apart from the aft section and abut the orifice in the extended position.

15 Claims, 4 Drawing Sheets

EXHAUST VALVE FOR MULTIPLE START TORPEDO

BACKGROUND

Exemplary embodiments pertain to the art of exhaust valves for multiple start torpedoes. Torpedoes power systems may be configured to start and stop to meet power demands.

BRIEF DESCRIPTION

Disclosed is a multiple start torpedo including an aft body having an exhaust conduit defining a turbine end and a seawater end having an orifice. The multiple start torpedo includes an exhaust valve associated with the exhaust conduit including. The exhaust valve includes a fore section having a head and a valve stem. The exhaust valve includes an aft section tapered from the turbine end to the seawater end and defining a receptacle sized to receive the valve stem. The exhaust valve includes a biasing member disposed to bias the head in an extended position spaced apart from the aft section and abut the orifice in the extended position.

In addition to one or more of the features described above, or as an alternative, further embodiments may include that the head defines a concave exterior surface and the orifice receives the concave exterior surface in the extended position.

In addition to one or more of the features described above, or as an alternative, further embodiments may include that the head in a compressed position forms a teardrop shape with the aft section.

In addition to one or more of the features described above, or as an alternative, further embodiments may include that the head defines a seawater catch basin oriented toward the seawater end such that seawater inflows drive the head toward the extended position.

In addition to one or more of the features described above, or as an alternative, further embodiments may include that the seawater catch basin has an outer surface that is substantially concave.

In addition to one or more of the features described above, or as an alternative, further embodiments may include that the aft section is cropped on the seawater end.

In addition to one or more of the features described above, or as an alternative, further embodiments may include that an exhaust valve diameter of the exhaust conduit is greater than an orifice diameter of the exhaust conduit.

In addition to one or more of the features described above, or as an alternative, further embodiments may include that the aft section is suspended by stanchions along an axis of the exhaust conduit having the exhaust valve diameter.

In addition to one or more of the features described above, or as an alternative, further embodiments may include that an exhaust valve diameter profile of the exhaust conduit is sized according to an outer profile of a teardrop shape formed by the head and the aft section in a compressed position.

In addition to one or more of the features described above, or as an alternative, further embodiments may include that an exhaust valve cross-sectional exhaust area of the exhaust conduit and an orifice cross-sectional exhaust area of the exhaust conduit is same.

Also disclosed is a multiple start torpedo including an exhaust valve having a fore section having a head and a valve stem. The exhaust valve includes an aft section and defining a receptacle sized to receive the valve stem. The exhaust valve includes a biasing member having an extended position where the head is spaced apart from the aft section and a compressed position where the head and the aft section form a teardrop shape.

In addition to one or more of the features described above, or as an alternative, further embodiments may include that the head forms an inner bulbous portion of the teardrop shape and the aft section forms an inner tail portion of the teardrop shape.

In addition to one or more of the features described above, or as an alternative, further embodiments may include an aft body having an exhaust conduit defining a turbine end and a seawater end.

In addition to one or more of the features described above, or as an alternative, further embodiments may include that the aft section is tapered toward the seawater end.

In addition to one or more of the features described above, or as an alternative, further embodiments may include that the head defines a seawater catch basin oriented toward the seawater end such that seawater inflows drive the head toward the extended position.

In addition to one or more of the features described above, or as an alternative, further embodiments may include that the seawater catch basin has an outer surface that is substantially concave.

In addition to one or more of the features described above, or as an alternative, further embodiments may include that the aft section is cropped on the seawater end.

In addition to one or more of the features described above, or as an alternative, further embodiments may include that an exhaust valve diameter of the exhaust conduit is greater than an orifice diameter of the exhaust conduit.

In addition to one or more of the features described above, or as an alternative, further embodiments may include that the aft section is suspended along an axis of the exhaust conduit.

Also disclosed is a multiple start torpedo including an exhaust valve having a fore section including a head defining a maximum outer diameter and a valve stem. The exhaust valve includes an aft section and defining a receptacle sized to receive the valve stem. The exhaust valve includes a biasing member having an extended position where the head is spaced apart from the aft section and a compressed position where the head and the aft section form an inner teardrop shape having an inner bulbous portion and an inner tail portion. The multiple start torpedo includes an exhaust conduit defining a seawater end and a turbine end, including an orifice defining an orifice diameter less than the maximum outer diameter such that the head is sized to block the orifice in the extended position, and including a contour having an outer teardrop shape that mimics the inner teardrop shape having an outer bulbous portion that joins the orifice toward the turbine end and an outer tail portion that extends toward the seawater end.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

A torpedo may include a propulsion system configured to propel the torpedo through a medium such as seawater. The propulsion system may be a hybrid electric propulsion system. Hybrid electric propulsion systems may allow a turbine or electric machine to propel the torpedo. The turbine may be used to charge an electric battery associated with the electric machine. After the battery has a full state of charge, the turbine is shut down, and the electric machine is used to propel the torpedo. An exhaust conduit associated with the turbine may guide exhaust from the turbine to exit the torpedo. The exhaust gas pressure may prevent seawater from entering portions of the exhaust conduit. When the turbine is shut down, seawater may enter the exhaust conduit and attempt to enter the turbine or other connected systems. The turbine may be started multiple times as required to charge the battery or propel the torpedo.

An exhaust valve may be disposed on the exhaust conduit to prevent seawater from entering the turbine cavity or other connected systems. The exhaust valve may be configured as a check valve such that exhaust gases from the turbine are expelled from the torpedo and seawater is blocked from entering. Further, the exhaust valve may be operated by a solenoid or motor actuator to adjust positions of the valve. The exhaust valve may exert back pressure on the turbine, reducing efficiency. The exhaust valve geometry may be configured to minimize back pressure and increase turbine efficiency.

Figure 1:
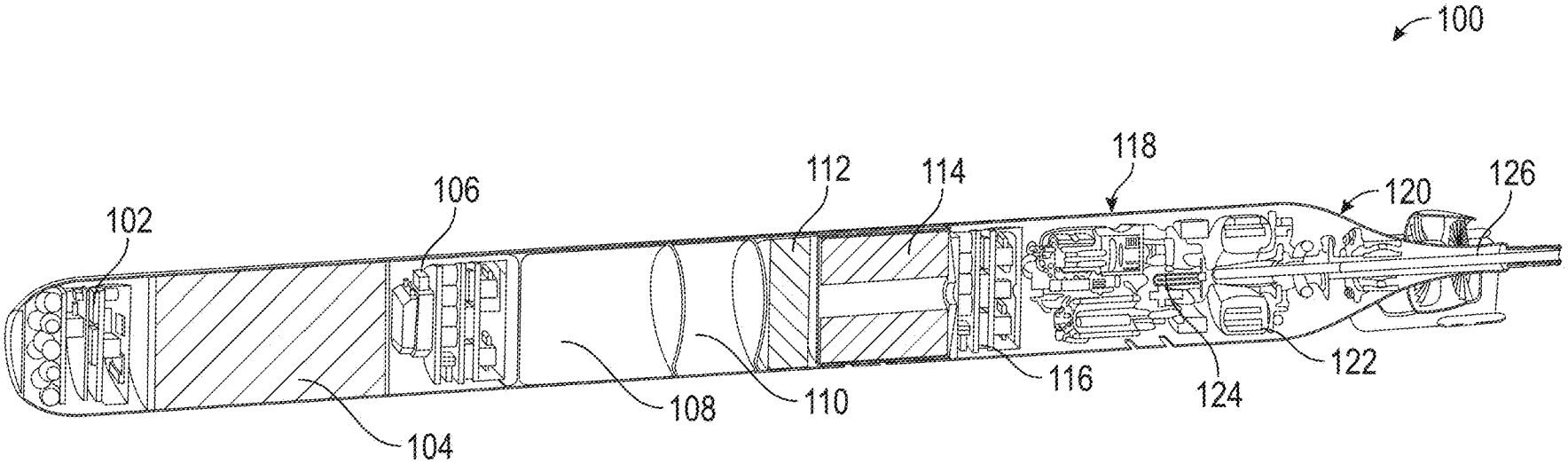
FIG. 1 is a system diagram for a hybrid electric torpedo.

Referring to FIG. 1 a torpedo 100 is shown. The torpedo 100 includes a homing system 102 configured to navigate to targets. The torpedo 100 includes a warhead module 104. The torpedo 100 includes an electronics module for operating the torpedo 100 and the warhead module 104. The torpedo 100 includes fuel 110 and an oxidizer 108. The torpedo 100 may include a guidance wire spool 114. Propulsion electronics 116 operate the hybrid electric propulsion system 118. The hybrid electric propulsion system 118 includes a propulsion electric machine 122, a turbine 124 and a combustion chamber. The torpedo 100 includes an aft body 120. The aft body 120 included a propulsor and an exhaust conduit 126 attached to the turbine outlet.

Figure 2:
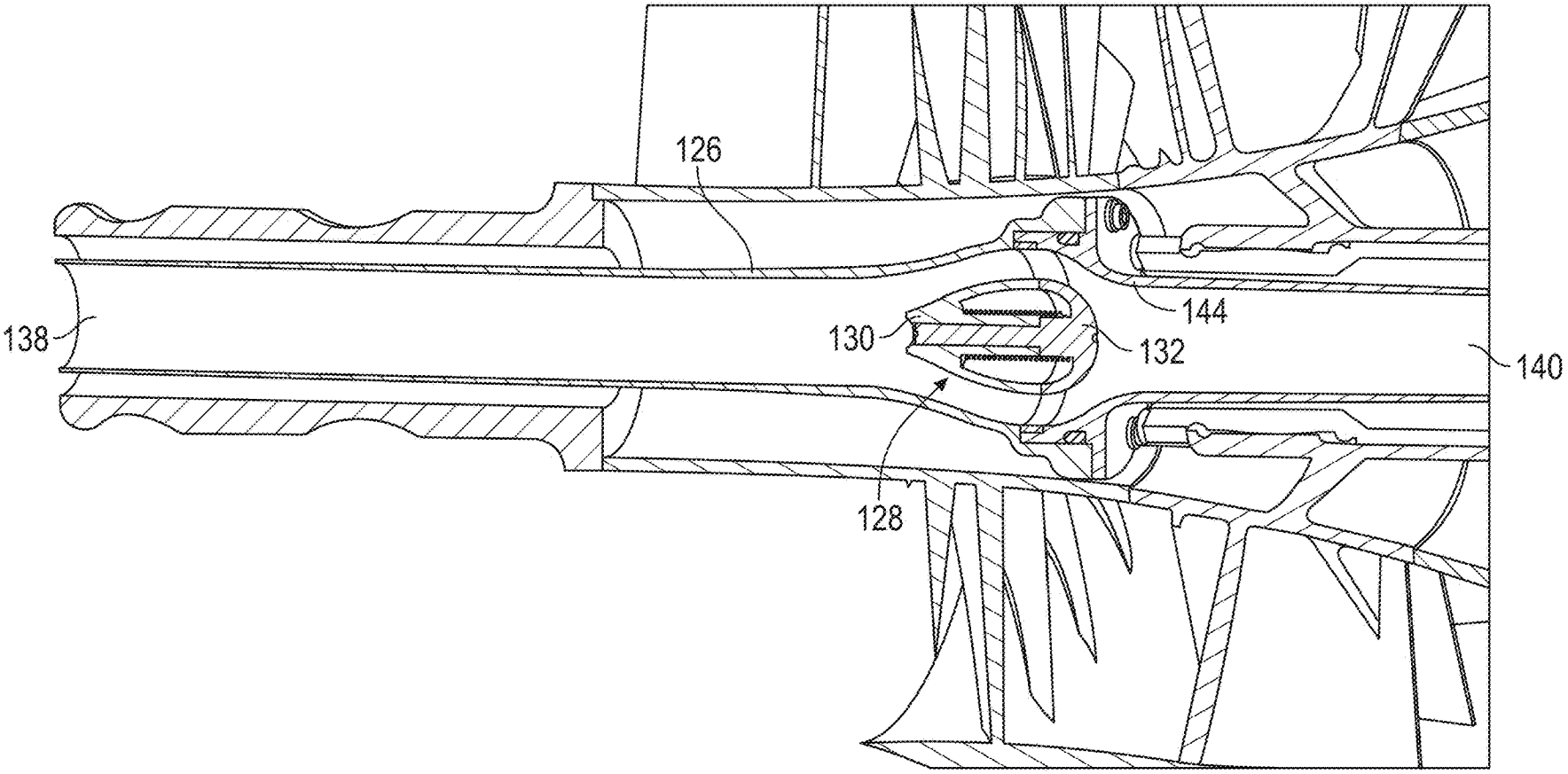
FIG. 2 is a cross-sectional side view of an exhaust conduit for a torpedo propulsion system.

Referring to FIG. 2, the torpedo aft body 120 is shown. The aft body 120 includes an exhaust conduit 126 and an exhaust valve 128. The exhaust valve 128 may be disposed within the exhaust conduit 126. The exhaust conduit 126 defines an orifice 144 for configured to receive a fore section 132 of the exhaust valve 128. Upon receipt, the orifice 144 is block, preventing seawater from traversing the orifice 144 from the seawater end 138. As such, seawater or other mediums of travel for the torpedo 100 are prevented from entering the turbine end 140 attached to turbine 124. The exhaust valve 128 includes an aft section 130.

Figure 3A:
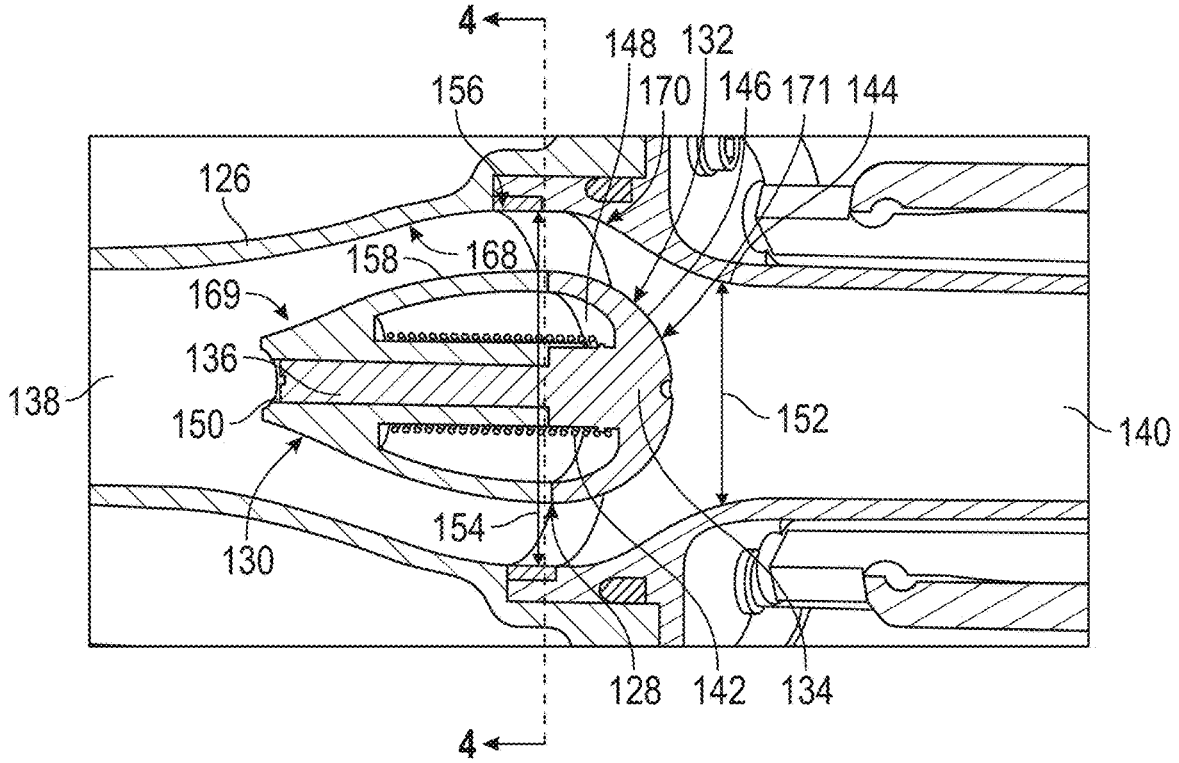
FIG. 3A is a cross-sectional side view of an exhaust valve in an extended position within an exhaust conduit of the hybrid electric torpedo.
Figure 3B:
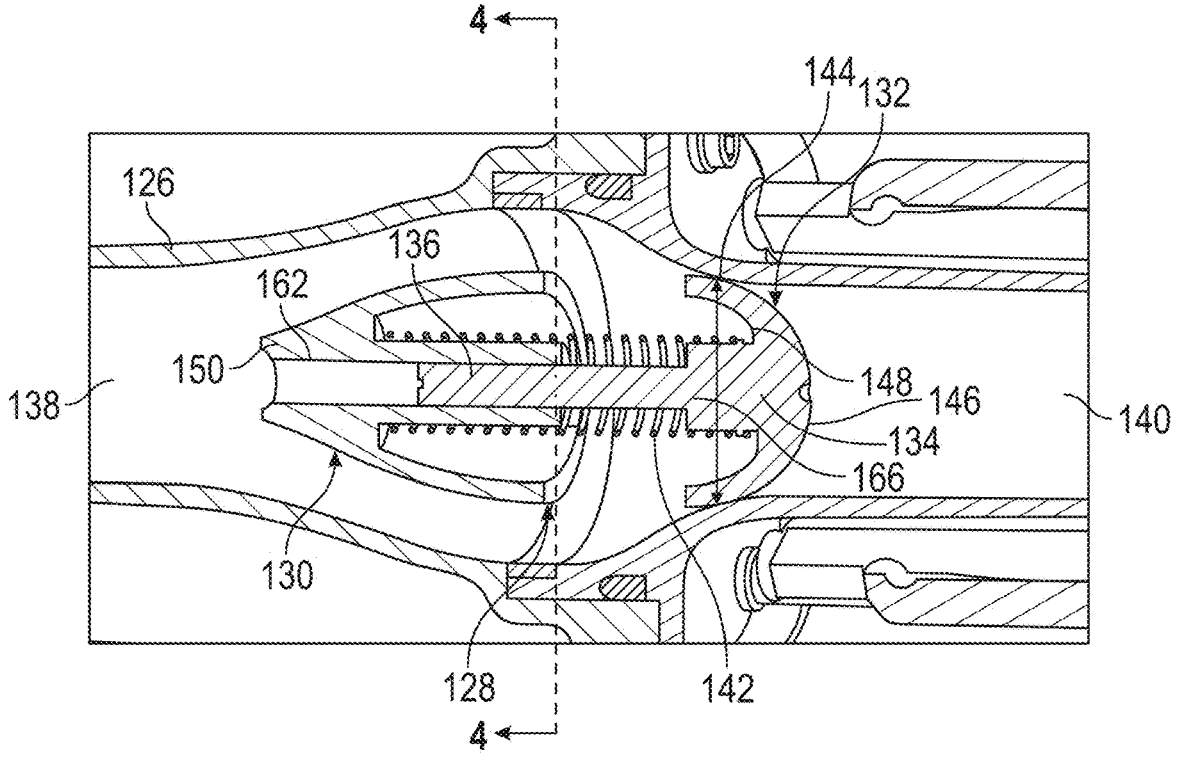
FIG. 3B is a cross-sectional side view of an exhaust valve of an exhaust conduit in a compressed position within an exhaust conduit of the hybrid electric torpedo.

Referring to FIG. 3A, the exhaust conduit 126 within torpedo aft body 120 is shown. The exhaust valve 128 is shown in a compressed position where fore section 132 meets or abuts the aft section 130. The aft section 130, as shown, tapers from the turbine end 140 to the seawater end 138, or from an inlet to an outlet of the exhaust conduit 126. The fore section 132 includes a head 134 and a valve stem 136. The valve stem 136 may be received by the aft section 130 and the head 134 may meet the aft section 130. The head 134 may have a concave exterior surface 146. The concave exterior surface 146 is curved to properly seat with the orifice 144 to block the backflow of seawater or other travel mediums from the seawater end 138.

As shown, the head 134 in a compressed position forms a teardrop shape with the aft section 130. Teardrop shape may have a inner bulbous end 171 and inner tail end 169 corresponding to outer tail portion 168 of the exhaust conduit 126 and outer bulbous portion 170 of the exhaust conduit 126, respectively. The teardrop shape or similar shapes may form an aerodynamic exhaust valve 128 that has a reduced backpressure with respect to the attached turbine 124. The head 134 defines a seawater catch basin 148 that is oriented toward the seawater end 138. As seawater flows from the seawater end 138 toward the turbine 124, the head 134 is forced closed by the seawater received at the catch basin 148 or biasing member 142. The catch basin 148 may have any form configured to receive water or liquid. The catch basin 148 may have an outer surface configured to receive seawater. The outer surface may be concave similar to that of the outer surface of the head 134. The aft section 130 may include crop 150. The exhaust conduit 126 may have a nonuniform diameter. That is, the exhaust conduit 126 may have an orifice diameter 152 defining orifice 144. The exhaust conduit 126 may also have an exhaust valve diameter 154. The exhaust valve diameter 154 may be located in the vicinity of exhaust valve 128. The exhaust conduit 126 may also define an exhaust valve diameter profile 156 such that the exhaust conduit 126 mimics the teardrop shape of exhaust valve 128. That is, the exhaust valve diameter profile 156 is substantially parallel with an outer profile of the exhaust valve 128 in the compressed position having a teardrop shape for a portion of the exhaust conduit 126 housing the exhaust valve 128. As such, the cross-sectional exhaust area. The exhaust valve diameter 154 may be greater than the orifice diameter 152.

Referring to FIG. 3AB, an exhaust valve 128 is shown in an extended position. Head 134 is shown abutting the orifice 144 in the extended position. The head 134 has a maximum outer diameter 166 that seals the orifice 144 in the extended position. The maximum outer diameter 166 is greater than the orifice diameter 152. The orifice 144 may be a filleted portion of the exhaust conduit 126 or an extension of the exhaust conduit 126 forming orifice diameter 152. The head 134 is shown blocking flow of fluid about the exhaust conduit 126. The aft section 130 includes a receptacle 162 for receiving the valve stem 136. As shown, the biasing member 142 biases the head 134 into the orifice 144 such that the head 134 is spaced apart from the aft section 130. The biasing member 142 may be any type of biasing device including springs, metal, motor operated actuators, or electromechanically actuated operations. The head 134 defines a seawater catch basin 148 that is oriented toward the seawater end 138. As seawater flows from the seawater end 138 toward the turbine 124, the head 134 is forced closed by the seawater received at the catch basin 148. The catch basin 148 may have any form configured to receive water or liquid. The catch basin 148 may have an outer surface configured to receive seawater. The outer surface may be concave similar to that of the outer surface of the head 134. The head 134 may have a concave exterior surface 146. The concave exterior surface 146 is curved to properly seat with the orifice 144 to block the backflow of seawater or other travel mediums from the seawater end 138.

Figure 4:
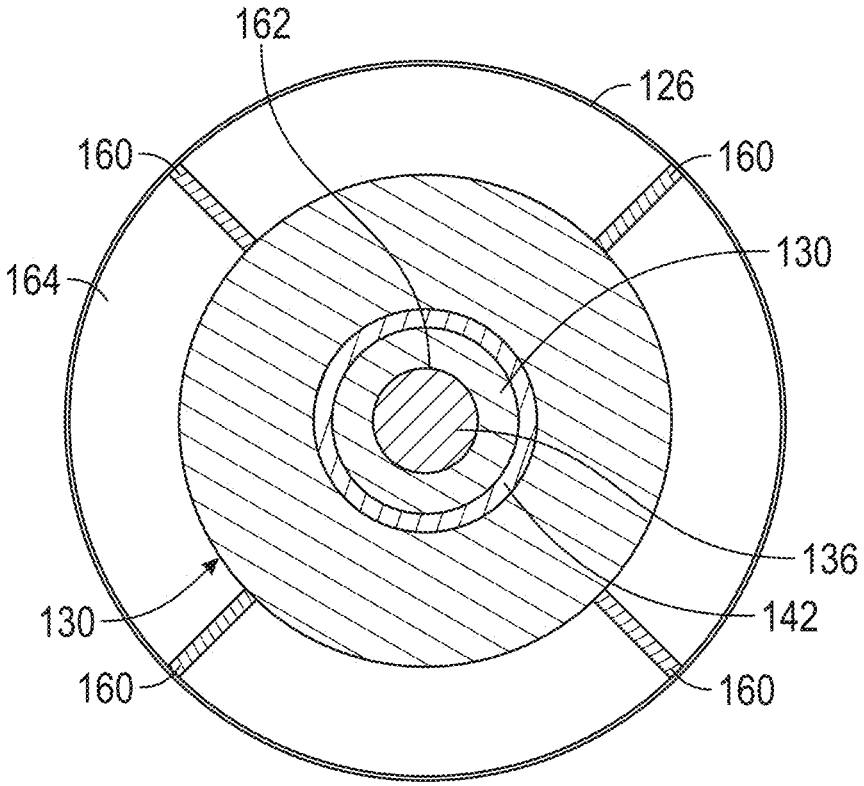
FIG. 4 is a cross-sectional front view of an exhaust valve of an exhaust conduit.

Referring to FIG. 4, a cross-section A-A is shown from a front aspect along an axis of the exhaust conduit 126. The aft section 130 of exhaust valve 128 is shown. The exhaust valve 128 includes biasing member 142 and valve stem receptacle 162. The aft section 130 is suspended from the exhaust conduit 126 by stanchions 160. Other suspension mechanisms may be employed, including mesh. A cross-sectional exhaust area 164 of the exhaust conduit 126 may be the same as the cross-sectional area of the orifice 144 cross-sectional exhaust area calculated as one half the orifice diameter 152 squared and multiplied by $\pi$.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A multiple start torpedo comprising:
an aft body having an exhaust conduit defining a turbine end and a seawater end having an orifice; and
an exhaust valve associated with the exhaust conduit including:
a fore section having a head and a valve stem;
an aft section tapered from the turbine end to the seawater end and defining a receptacle sized to receive the valve stem; and
a biasing member disposed to bias the head in an extended position spaced apart from the aft section and abut the orifice in the extended position;
wherein:
the head defines a concave exterior surface and the orifice receives the concave exterior surface in the extended position; and
the head defines a seawater catch basin oriented toward the seawater end such that seawater inflows drive the head toward the extended position.

2. The multiple start torpedo of claim 1, wherein the head in a compressed position forms a teardrop shape with the aft section.

3. The multiple start torpedo of claim 1, wherein the seawater catch basin has an outer surface that is substantially concave.

4. The multiple start torpedo of claim 1, wherein the aft section is cropped on the seawater end.

5. The multiple start torpedo of claim 1, wherein an exhaust valve diameter of the exhaust conduit is greater than an orifice diameter of the exhaust conduit.

6. The multiple start torpedo of claim 5, wherein the aft section is suspended by stanchions along an axis of the exhaust conduit having the exhaust valve diameter.

7. The multiple start torpedo of claim 5, wherein an exhaust valve diameter profile of the exhaust conduit is sized according to an outer profile of a teardrop shape formed by the head and the aft section in a compressed position.

8. The multiple start torpedo of claim 5, wherein an exhaust valve cross-sectional exhaust area of the exhaust conduit and an orifice cross-sectional exhaust area of the exhaust conduit is same.

9. A multiple start torpedo comprising:
an exhaust valve including
a fore section having a head and a valve stem,
an aft section and defining a receptacle sized to receive the valve stem, and
a biasing member having an extended position where the head is spaced apart from the aft section and a compressed position where the head and the aft section form a teardrop shape;
wherein:
the head forms an inner bulbous portion of the teardrop shape and the aft section forms an inner tail portion of the teardrop shape;
the multiple start torpedo further comprises, an aft body having an exhaust conduit defining a turbine end and a seawater end; and
the head defines a seawater catch basin oriented toward the seawater end such that seawater inflows drive the head toward the extended position.

10. The multiple start torpedo of claim 9, wherein the aft section is tapered toward the seawater end.

11. The multiple start torpedo of claim 9, wherein the seawater catch basin has an outer surface that is substantially concave.

12. The multiple start torpedo of claim 9, wherein the aft section is cropped on the seawater end.

13. The multiple start torpedo of claim 9, wherein an exhaust valve diameter of the exhaust conduit is greater than an orifice diameter of the exhaust conduit.

14. The multiple start torpedo of claim 9, wherein the aft section is suspended along an axis of the exhaust conduit.

15. A multiple start torpedo comprising:
an exhaust valve including:
a fore section including a head defining a maximum outer diameter and a valve stem;
an aft section and defining a receptacle sized to receive the valve stem; and
a biasing member having an extended position where the head is spaced apart from the aft section and a compressed position where the head and the aft section form an inner teardrop shape having an inner bulbous portion and an inner tail portion; and
an exhaust conduit defining a seawater end and a turbine end, including an orifice defining an orifice diameter less than the maximum outer diameter such that the head is sized to block the orifice in the extended position, and including a contour having an outer teardrop shape that mimics the inner teardrop shape having an outer bulbous portion that joins the orifice toward the turbine end and an outer tail portion that extends toward the seawater end.

* * * * *